US005951897A

United States Patent [19]

Wauer et al.

[11] Patent Number: 5,951,897

[45] Date of Patent: Sep. 14, 1999

[54] TEMPERATURE MEASURING DEVICE FOR A REGULATING CIRCUIT OF AN ELECTRICAL RADIANT HEATING APPLIANCE

[75] Inventors: Roman-Hartmut Wauer, Kisslegg; Berndt Gierer, Lindau/Bodolz; Pia Krause, Rotenbach, all of Germany

[73] Assignee: AKO-Werke GmbH & Co. KG, Germany

[21] Appl. No.: 08/791,871

[22] Filed: Jan. 31, 1997

[30] Foreign Application Priority Data

Feb. 9, 1996 [DE] Germany ..... 196 04 658

[51] Int. Cl.[6] ..... H05B 3/68; H05B 3/02

[52] U.S. Cl. ..... 219/448.11; 219/507; 219/509

[58] Field of Search ..... 219/448, 449, 219/451, 452, 464, 490, 494, 497, 507, 509, 510

[56] References Cited

U.S. PATENT DOCUMENTS

| | | | |
|---|---|---|---|
| 3,789,190 | 1/1974 | Orosy et al. | 219/497 |
| 3,808,451 | 4/1974 | Pittet | 307/64 |
| 3,869,597 | 3/1975 | Strange | 219/497 |
| 3,912,905 | 10/1975 | Giler | 219/464 |
| 4,506,146 | 3/1985 | Rice et al. | 219/499 |
| 4,546,238 | 10/1985 | Ahs | 219/497 |
| 4,636,619 | 1/1987 | Sugimori | 219/497 |
| 4,714,822 | 12/1987 | Braun et al. | 219/449 |
| 4,772,779 | 9/1988 | Scheidler et al. | 219/449 |
| 4,810,857 | 3/1989 | Goessler | 219/449 |
| 5,220,155 | 6/1993 | Cunningham | 219/464 |
| 5,396,047 | 3/1995 | Schilling et al. | 219/449 |

FOREIGN PATENT DOCUMENTS

| | | |
|---|---|---|
| 2 208 485 | 8/1973 | Germany . |
| 2 309 104 | 9/1974 | Germany . |
| 28 50 859 B1 | 11/1978 | Germany . |
| 29 36 890 A1 | 3/1980 | Germany . |
| 31 00 758 A1 | 9/1982 | Germany . |

*Primary Examiner*—Teresa Walberg
*Assistant Examiner*—Sam Paik
*Attorney, Agent, or Firm*—Scully, Scott, Murphy & Presser

[57] ABSTRACT

Proposed is a temperature measuring device for a regulating circuit (10) in particular of an electrical radiant heating appliance with a heating conductor (2) arranged beneath a glass ceramic cooking surface (1), in which the heating conductor (2) itself suffices for temperature detection. There is provided a change-over switch (6) which cyclically connects the heating conductor (2) to a resistance measuring circuit (7). It detects the respective temperature-dependent ohmic resistance value of the heating conductor (2) and produces a temperature-proportional control signal for the regulating circuit (10).

6 Claims, 1 Drawing Sheet

TEMPERATURE MEASURING DEVICE FOR A REGULATING CIRCUIT OF AN ELECTRICAL RADIANT HEATING APPLIANCE

BACKGROUND OF THE INVENTION

1. Field of the Invention

The invention concerns a temperature measuring device for a regulating circuit in particular of an electrical radiant heating appliance with a heating conductor arranged beneath a glass ceramic cooking surface.

2. Discussion of the Prior Art

DE 31 00 758 A1 describes a switch device for cooking appliances with a glass ceramic plate, wherein a mechanical expansion element is disposed as a temperature sensor between the glass ceramic plate and a heating conductor. When a reference temperature is reached the heating conductor is switched off by means of a switch contact which is coupled to the expansion element, and it is switched on again with a certain hysteresis effect.

A temperature regulator for electrical cooking plates with a hydraulic temperature sensor is known from DE 28 50 389 B2.

Prior German patent application No. 195 22 748 describes a regulating device for a hot plate radiant heating arrangement. The mechanical expansion sensor which is also provided here is additionally heatable by means of an additional heating body whose output power is adjustable by means of a control member.

In all cases in the state of the art referred to, a specific sensor element is required for detecting the temperature of the cooking surface.

DE 29 36 890 C2 discloses a temperature regulation system for an electrical surface heating arrangement. A heat-sensitive element is arranged between the heating element and a temperature sensor electrode. The heating element itself is admittedly part of the temperature sensor arrangement, but in this case also additional elements, more specifically the temperature sensor electrode and the heat-sensitive element, are necessary for temperature detection purposes.

SUMMARY OF THE INVENTION

The object of the present invention is to propose a temperature measuring device of the kind set forth in the opening part of this specification, in which the heating conductor itself is sufficient for temperature detection.

In accordance with the invention, in a temperature measuring device of the kind set forth in the opening part of this specification, that object is attained in that there is provided a change-over switch which cyclically connects the heating conductor to a resistance measuring circuit which detects the respective temperature-dependent ohmic resistance value of the heating conductor and produces a temperature-proportional control signal for the regulating circuit.

Commercially available heating conductor wires which can be used for radiant heating arrangements have known resistance characteristics or temperature coefficients. In accordance with the invention, in operation the respective resistance value of the heating conductor is detected and evaluated for the purposes of regulating the heating output power. That means that a specific temperature sensor is no longer required. The heating conductor therefore performs a dual function insofar as on the one hand it heats the cooking surface and on the other hand it detects the temperature thereof so that the regulating circuit regulates the temperature of the cooking surface to an adjustable reference value.

In order to ensure that the resistance measuring circuit detects the temperature obtaining at the cooking surface and not just the actual temperature of the incandescent heating conductor itself, the resistance measuring circuit evaluates the ohmic resistance value of the heating conductor only after a cooling-down time as the control signal for the regulating circuit, the cooling-down time being such that the temperature of the heating conductor is a reflection of the temperature of the cooking surface.

In an advantageous development of the invention, in the event of a heating conductor resistance value which occurs in the event of the heating conductor being at an excessive temperature, the resistance measuring circuit produces a switch-off signal for the regulating circuit. That provides that the heating conductor can be operated at a temperature up to very close to its limit temperature. That has the advantage that at most slight safety reserves have to be taken into consideration in terms of calculating the service life to be guaranteed for the heating conductor. Accordingly the dimensioning of the heating conductor can be fully utilised in operation. That switch-off signal acts only for a brief period of time until the temperature of the heating conductor has fallen below the excessive temperature.

In order to detect faults and troubles in the heating conductor such as for example a short-circuit and/or a break in the heating conductor, the resistance measuring circuit, at a resistance value outside the operationally usual range, produces a switch-off signal for the regulating circuit and an alarm circuit.

The described temperature measuring device can be used not only in relation to a radiant heating appliance but also in relation to other heating apparatuses in which the heating conductor wire is in the immediate vicinity of the measurement location. As the heating conductor wire for determining the ambient temperature must be separate from the power feed circuit, use thereof is possible in particular where a large thermal mass is to be heated, as is the case for example with night storage heaters.

BRIEF DESCRIPTION OF THE DRAWINGS

Further advantageous configurations of the invention are set forth hereinbelow in detail and are apparent from the following description of a specific embodiment. In the drawing.

DETAILED DESCRIPTION OF A PREFERRED EMBODIMENT

Figure 1:
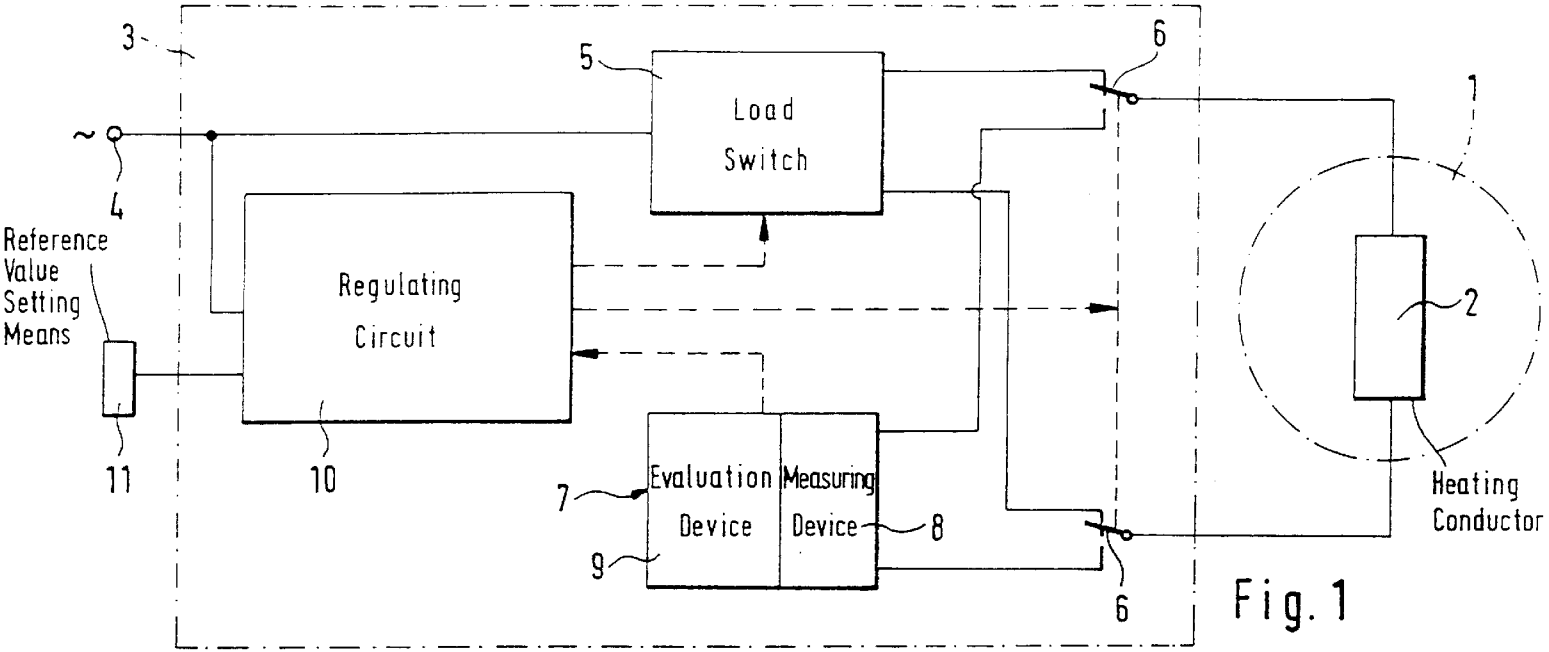
FIG. 1 shows a block circuit diagram of a radiant heating arrangement of a cooking surface of a radiant heating appliance.

Disposed in the usual manner at a spacing beneath a cooking surface 1 of a glass ceramic plate is a heating conductor 2. The heating conductor 2 forms a spirally routed heating coil. The heating conductor 2 comprises a resistance wire having a positive temperature coefficient. The heating conductor 2 is connected to a power regulator 3 which is connected to the electrical mains system 4.

The power regulator 3 operates with an electronic load switch 5 to which the heating conductor 2 is connected by way of a two-pole change-over switch 6. The change-over switch 6 is preferably formed by electronic components.

Connected to the change-over switch 6 is a resistance measuring circuit 7 having an electronic measuring device 8 and an electronic evaluation device 9. The resistance measuring circuit 7 produces a control signal for a regulating circuit 10 which controls the electronic load switch 5 and the change-over switch 6. A reference value setting means 11 is connected to the regulating circuit 10.

The mode of operation of the described circuit is essentially as follows:

In the position of the change-over switch 6 shown in FIG. 1 the heating conductor 2 is connected to the mains system 4 by way of the load switch 5 and a corresponding load current flows therethrough. The heating conductor 2 is incandescent and by means of radiant heat heats the cooking surface 1 or a vessel disposed thereon.

Cyclically, for example every 5 to 10 seconds, the change-over switch 6 is switched over by the regulating circuit 10 so that the incandescent heating conductor 2 is connected to the electronic measuring device 8. In that situation, the latter detects the respective temperature-dependent ohmic resistance value of the heating conductor 2, for example by applying a dc voltage to the heating conductor 2 and measuring the current that flows. From the measured resistance value, the electronic evaluation device 9 produces a corresponding temperature-proportional control signal for the regulating circuit 10.

Figure 2:
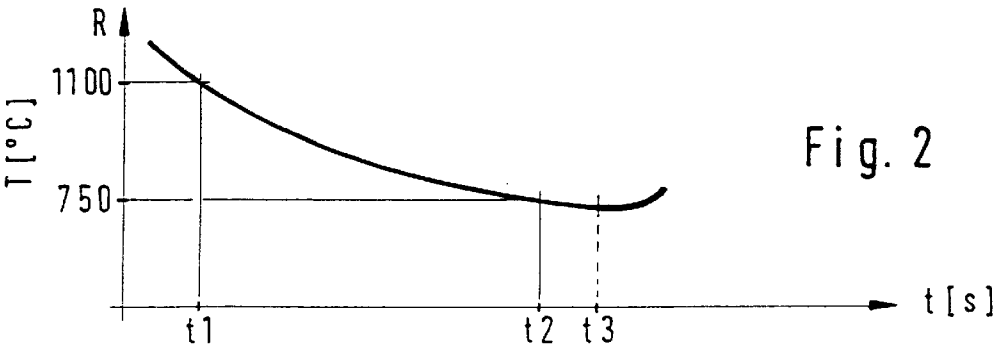
FIG. 2 shows a resistance/temperature time graph of the heating conductor.

When the resistance value which occurs immediately after the switch 6 has been switched over (see t1 in FIG. 2) is evaluated, that then corresponds to the incandescence temperature (about 1100° C.) of the heating conductor 2. To evaluate that inherent resistance of the heating conductor 2, it is desirable if the described circuit aims to avoid a maximum incandescence temperature of the heating conductor 2 being exceeded. If the maximum incandescence temperature is attained, then the heating conductor 2 remains switched off from the mains system 4 for a certain time.

The described circuit alms in particular to detect the temperature of the cooking surface 1. For that purpose the incandescent heating conductor 2 which has been previously switched on remains switched off for a certain cooling-down time (t2–t1, for example about 1 second), until it is no longer incandescent or is only still darkly incandescent. That is the case in the temperature range of about 750° C. The temperature obtaining at the heating conductor 2 now involves the temperature of the cooking surface 1. Its resistance is thus a reflection of the temperature of the cooking surface 1 (see t2, t3 in FIG. 2). The cooling-down time may be of a fixed value. It is however also possible, after the change-over switch 6 has been switched over (time t1), for the resistance of the heating conductor 2 to be measured repeatedly and for the measurement value to be evaluated only when the resistance which falls in an e-function still changes only slightly (see t2, t3 in FIG. 2). That is the situation when the heating conductor 2 is practically no longer incandescent and its resistance is a reflection of the temperature of the cooking surface, which is for example in the temperature range around 750° C. A temperature-proportional control signal for the regulating circuit 10 is produced from the resistance value which is measured in the time t3–t2, and that regulating circuit 10 accordingly correspondingly controls the load switch 5 in dependence on the set reference value, when the heating conductor 2 is subsequently switched over to the load switch 5. The measurement time t3–t2 is for example about 0.3 seconds. It is also possible, at the beginning of a measurement operation, directly after the time t1, to perform the measurement step at some points on the e-function and to extrapolate the further curve configuration from the measurement value variation and thereafter calculate the ambient temperature. The overall measurement time can in that case be shorter than the cooling-down time t2–t1. Depending on the respective degree of accuracy required measurement value detection can be interrupted at an earlier or a later time (before t2).

The overall cooling-down time t3–t1 is substantially less than the above-indicated cycle time in accordance with which the described measurement operation is repeatedly effected so that the actual heating time is longer than the measurement time.

In order to avoid the change-over switch 6 switching the load current, the regulating circuit 10 switches off the load switch 5 before the change-over switch 6 is switched from the load switch 5 to the resistance measuring circuit 7 and it switches the load switch 5 on only when after the measuring operation the change-over switch 6 is switched back from the resistance measuring circuit 7 to the load switch 5.

It is also possible by means of the resistance measuring circuit 7 to detect a resistance value which is outside the operationally usual range and to produce a switch-off signal for the regulating circuit 10 as well as an alarm signal. Such a resistance value outside the operationally usual range is for example a short-circuit and/or a break In the heating conductor 2. In the case of a heating conductor with a positive temperature coefficient, an operationally unusual resistance value is also one which is substantially smaller than the resistance value which occurs at ambient temperature and/or which is substantially greater than the resistance value which occurs at maximum incandescence temperature.

We claim:

1. A temperature measuring device for a regulating circuit of an electrical radiant heating appliance with a heating conductor arranged beneath a glass ceramic cooking surface, wherein a change-over switch (6) cyclically connects the heating conductor (2) to a resistance measuring circuit (7) which detects a respective temperature-dependent ohmic resistance value of the heating conductor (2) and generates a temperature-proportional control signal for the regulating circuit (10) said resistance measuring circuit (7) evaluating the ohmic resistance of the heating conductor (2) only after a cooling-down time (t3–t1) as a control signal for the regulating circuit (10), the cooling-down time being such that the temperature of the heating conductor (2) is indicative of the temperature of the cooking surface (1), the resistance of the heating conductor (2) being evaluated only when its temperature is at most still altering slightly; and a load switch (5), which is controlled by the regulating circuit (10), wherein the load switch (5) controls the heating conductor (2) and selectively switches off before the heating conductor (2) switches over to the resistance measuring circuit (7) and switches on after the heating conductor (2) switches back to the load switch (5).

2. A temperature measuring device according to claim 1 wherein the cooling-down time has a fixed value.

3. A temperature measuring device according to claim 1, wherein the regulating circuit (10) switches the change-over switch (6) cyclically, about every 5 to 10 seconds, for a short time relative to the resistance measuring circuit (7).

4. A temperature measuring device according to claim 1, wherein the change-over switch (6) is a two-pole switch.

5. A temperature measuring device according to claim 1, wherein upon the presence of a heating conductor resistance value encountered due to an excessive temperature of the heating conductor (2), the resistance measuring circuit (7) generates a switch-off signal for the regulating circuit (10).

6. A temperature measuring device according to claim 1, wherein in the presence of a heating conductor resistance value outside an operationally specified range, the resistance measuring circuit (7) generates a switch-off signal for the regulating circuit and an alarm signal.

* * * * *